US006564537B2

(12) United States Patent
Galan Pujol

(10) Patent No.: US 6,564,537 B2
(45) Date of Patent: May 20, 2003

(54) RING TWISTING AND WINDING SPINNING MACHINE WITH AUTONOMOUS AND INDEPENDENT UNITARY PRODUCTION MODULES

(75) Inventor: Jose Galan Pujol, Terrassa (ES)

(73) Assignee: Galan Textile Machinery, Terrassa (ES)

( * ) Notice: Subject to any disclaimer, the term of this patent is extended or adjusted under 35 U.S.C. 154(b) by 0 days.

(21) Appl. No.: 09/939,009

(22) Filed: Aug. 24, 2001

(65) Prior Publication Data

US 2002/0014065 A1 Feb. 7, 2002

Related U.S. Application Data

(63) Continuation of application No. PCT/ES00/00270, filed on Jul. 21, 2000.

(51) Int. Cl.[7] ..... D01H 7/52
(52) U.S. Cl. ..... 57/75; 57/264
(58) Field of Search ..... 57/75, 119, 120, 57/121, 122, 123, 124, 125, 136, 137, 264; 700/139, 142

(56) References Cited

U.S. PATENT DOCUMENTS 5,590,045 A * 12/1996 Kaaket et al. ..... 364/470.1
5,813,210 A * 9/1998 Musha et al. ..... 57/264

* cited by examiner

*Primary Examiner*—John J. Calvert
*Assistant Examiner*—Shaun R Hurley
(74) *Attorney, Agent, or Firm*—Jonathan Grant

(57) ABSTRACT

The invention relates to a ring twisting and winding spinning machine with autonomous and independent unitary production modules.

7 Claims, 7 Drawing Sheets

4
11
10
7
9
6
5
12
13

FOLDING FORMS

RING TWISTING AND WINDING SPINNING MACHINE WITH AUTONOMOUS AND INDEPENDENT UNITARY PRODUCTION MODULES

CROSS REFERENCE

This application is a continuation of application of PCT/ES00/00270, with an international filing date of Jul. 21, 2000.

OBJECT OF THE INVENTION

The object of the present invention is a ring twisting and winding spinning machine with autonomous and independent unitary production modules with direct motorised spindles, for simultaneous production of gathered and twisted threads of different diameters and natural and synthetic materials, in bobbins of different formats and dimensions.

BACKGROUND OF THE INVENTION

The spinning and twisting machines existing at the present time, among them we can mention the one disclosed in PCT-WO 98/39504 of GALAN I LLONGUERAS "Modular machine for spinning and doubling with elements for transmitting individually the spindles with conical or double conical continuous and individual folding system", comprising all of them three main units: a) a feeding unit in charge of supplying the machine with sets of unitary threads, in a continuous way, threads coming from a previous installation embedded at the machine and independent of it; b) a ring rail unit that is an element with ring shape, placed in a concentric way with the coil reel and independent of it and having an upward-descending vertical alternative movement in order to guide and place the thread on a certain point of finished product coil reel; and c) a spindle unit consisting of a motorised shaft on which a reel or tube is placed for rolling the thread delivered by the ring rail.

Considering the spindle as a production unit, all the existing machines consist of a multiple number of production units.

Any of the existing machines is provided with motorization systems which are, essentially:

- for the feeding unit: a single motor and its corresponding variation and reduction speed system for the entire machine, so that the feeding speed of thread to every spindle is equal providing the delivery of the same length of thread by time unit. This feeding speed can be modified, but it is always identical for all the spindles of the machine, since all the feedings of the different spindles are carried out by mean of feeding turning rollers common to all lines or spinning spindles.
- for the ring unit: a single motor and its corresponding system of reduction and variation of displacement speed and frequency of the ascending-descending movement of the ring rails along the reels, for the entire machine. This speed can be modified, but it is always identical for all the ring rails of the machine, since the transmission of the motor movement is carried out by means of singular elements common to all the ring rails.
- for the spindles unit: either a single motor and its corresponding system of reduction and variation of the turning speed of the spindles for the entire machine; or a motor and its corresponding system of reduction and variation of the turning speed of the spindle for each spindle, in order that all the spindles of the machine can rotate at different speeds and with different rolling directions, as in the case of the mentioned patent WO 98/39504.

All these systems that have been progressively solving the different problems and inefficiencies posed at mass production of differentiated products of the textile factories, however, they don't have capacity to solve all the following problems:

- complete stops of machines originated by failures of common electric general elements of manoeuvre, like power supplies, programmer and other electric equipment.
- complete stops of machines originated by failures in the supplying unit.
- complete stops of machines originated by failures in the ring rail movement.
- limited flexibility for simultaneous production of threads of different material and/or diameter, for the use of reels of different diameters, and for obtaining different folding forms and longitudes of reel, due to the fact that the speeds and rolling directions of the feedings and of the ring rails are obligatory equal for all the spindles of the machine, even more in those cases in that all the spindles of the machine have a common unique motorization.
- excess of production capacity for small textile factories.
- plant distribution not very versatile, as consequence of the longitudinal dimension of the spinning machines of multiple spindles, that should have all of them located in the same longitudinal plane due to the unity of the feeding unit and of the ring rail motorization.

DESCRIPTION OF THE INVENTION

Regarding to the feeding and ring rails units a ring twisting and winding spinning machine with autonomous and independent unitary production modules has been developed in order to solve the above mentioned problems, all of them caused by the impossibility to have reliability and flexibility for optimum production of different products in a machine which main movements are identical and they affect simultaneously to several production lines. Essentially, it means that each module is provided of an unique spindle with its corresponding ring rail and feeding.

It is necessary to describe the unitary module since the machine is constituted by an indefinite number of modules, only determined by the final user of unitary modules.

This unitary module is constituted by a frame formed by two vertical plates of steel foil, bent by its lower part in right angle, to house the lower supports of the module, said two plates being united to each other by means of horizontal bars, an inferior platform and a horizontal bed plate of steel foil bent in "U",form, that will serve to support the spindle motor. The rigid structure, this way created, serves as support for all the groups forming the module, which will be housed between its two vertical plates of steel foil. This constructive form allows to join modules to each other, embedding them laterally and fixing them to each other by means of screws that join the mentioned vertical plates, so that a machine is formed, whose number of modules can be as high as it is physically possible, and it only depends on the characteristics of the premises where it will be placed. Even more, joining of adjacent modules can be carried out in other different ways, by means of intermediate connection pieces, so that the machine formed by several modules can have an arrangement in plant, either rectilinear or open or closed polygonal, therefore the machine being adaptable to the form in plant of the premises.

The spindle unit is installed on the horizontal bed plate of foil above mentioned. The motor of this spindle unit is screwed to the bed plate lower part, with its vertical shaft upward; this motor is an alternating current, triphasic, asynchronous and of high efficiency and its output speed is controlled by a frequency variator. It is provided of an integrated pulse detector that controls the number of revolutions. Between the bed plate of steel foil and the motor some stabilisers are placed to soften vibrations that can be produced by the spindle operation, so that they are not transferred neither to the rest of the components of the module nor to the adjacent modules. The motor output shaft is a Morse taper on which the spindle is mounted, this is a vertical shaft that can adopt different forms, on which is mounted the reel or tube in that the thread is coiled, reel which rotates together with the spindle by means of some dragging pieces. The motor shaft has a protecting piece to avoid remains of thread being coiled in it.

The ring rail unit is constituted by the driving system, the ring support, the ring, the traveller and the control hoop. The driving system consists of an alternating current asynchronous triphasic motor-reducer controlled by a frequency variator, a traction geared belt with its corresponding guide pulleys and a carriage with rollers that is moved alternatively by this belt along vertical guides in ascending and descending way with a frequency and according to a sequence predetermined by means of a functions programmer that will be described below; a pulse generator controls the position and speed of the driving carriage. A support of bent steel foil, in which is housed the ring, is fixed to this driving carriage in a concentric way with the spindle and the reel by which circumference the traveller circulates, which is the piece that guides the thread in its coiling along the reel giving at the same time a torsion predetermined by means of the above mentioned functions programmer. A control hoop, also concentric with the spindle, and its reel avoids the convex effect due to the centrifugal force of the thread that will enter in the reel; this control hoop can be mounted on the ring support or have an independent movement, generated in the same way as the ring. A cowling in front of the spindle protects the operator against the possible impact of a loosened traveller off the ring and against the risk of entanglement with the thread that is entering in the spool.

The feeding unit, located in the upper part of the module, is constituted by an asynchronous triphasic alternating current motor controlled by a frequency variator and provided with a pulse detector that controls the number of revolutions. This motor is arranged with its output shaft in horizontal position that, through a properly protected geared belt, transmits its movement to two horizontal traction cylinders made of chromed steel that rotate at the same speed and with the same rolling direction and they pull the thread toward the spindle. A third horizontal cylinder, parallel to the previous ones, not motorised, of chromed steel or with rubber coating and mounted on an arm that can rotate over a horizontal shaft, rests by gravity on the other two cylinders, thus transmitting an appropriate tension to the thread that circulates between this two pulling cylinders and the pressure roller; this horizontal pressure roller can be raised to eliminate said pressure. On the horizontal fixed turn shaft of the arm of the pressure cylinder, a pulley is mounted that picks up the thread at its output of the traction rollers and it directs the thread toward the yarn guide, which is a piece fixed to the frame with a hole at one end, by which the thread is crossed to its path toward the traveller of the ring rail unit.

The three motors (feeding, ring rail, spindle) are provided with frequency variators that are housed in the electric operation and control rack made of steel foil located at the rear part of the module and mounted on some vibration proof pieces, and said motors are controlled and synchronised by a programmer of functions located in the machine frontal cowling, that controls all operation variables or parameters of each module. The programmer of functions consists of a control card, a keyboard and a display which allows to introduce, modify and control the key parameters, as the feeding speed, the speed and sequence of movement of the ring rail in order to set the types of bobbins to form and the speed and turning direction of the spindle and other optional accessories. The same parameters can be introduced in a collective way in several modules simultaneously it is desired. This can be done by a master functions programmer through that by means of a communications bus, transmits the same instructions to the programmers of the selected modules, so that individual parameters of each module can be modified independently at any moment.

The ring twisting and winding spinning machine with autonomous and independent unitary production modules has a series of advantages essentially originated by a complete freedom and flexibility of selection of the working parameters of the three main units of each module:

It allows to obtain bobbins of different formats and dimensions in several modules simultaneously (see examples in FIG. 7) since the speed, excursion and movement sequence of each ring rail is independent, being able to reach in each module a different bobbin height (variable between about 200 and 800 mm).

It allows to modify the rolling direction of the feeding rollers of a module, as they are independent for each module.

It ensures the obtention of the highest density of reels filling for every module of the machine simultaneously, because it is possible to set the ring rail speed individually in each module as a function of the thread thickness.

It ensures the obtention of the maximum production capacity in each of the modules of the machine because:

Capacity =feeding speed (m/minute) =speed of spindle (r.p.m.)/ twist (turns/m)

and being the twist a constant only dependent from the physical characteristics of the thread to process, the possibility of setting the allowed maximum speed of the spindle for each module ensures the possibility to obtain the maximum production capacity per each module.

It is possible to produce threads of different physical characteristics in different modules of a machine achieving in each module the maximum capacity depending on the thread type and the desired form of bobbin as a consequence of the above-mentioned features, and since the drivers of the spindles and feedings are independent.

The machine can be constituted by any number of independent modules and it can be enlarged by unitary modules, since each module has independent drivers.

Since it doesn't exist common elements between modules, addition of new modules to machines in productive process can be made without stopping their operation.

Mechanics as well as electric or electronic failures of a module don't affect to any other module.

The machine distribution plant is completely versatile and must not necessarily be linear as usually, since there are no common drive elements The machine installation in the factory is much simpler than the usual and it can be carried out by the customer itself, since there are not large structures to be mounted, aligned and levelled, therefore the starting of the production process is much faster.

On the other hand, the spindle driven in a direct way by the motor, without transmissions, has the advantage of not producing mechanical noises neither vibrations, besides of a more reduced maintenance because transmissions to lubricate and set gage are not necessary.

BRIEF DESCRIPTION OF THE DRAWINGS

For a better understanding of the present invention, a preferred embodiment of the ring twisting and winding spinning machine with autonomous and independent unitary production modules is described on the following drawings.

PREFERRED EMBODIMENT OF THE INVENTION

Figure 1:
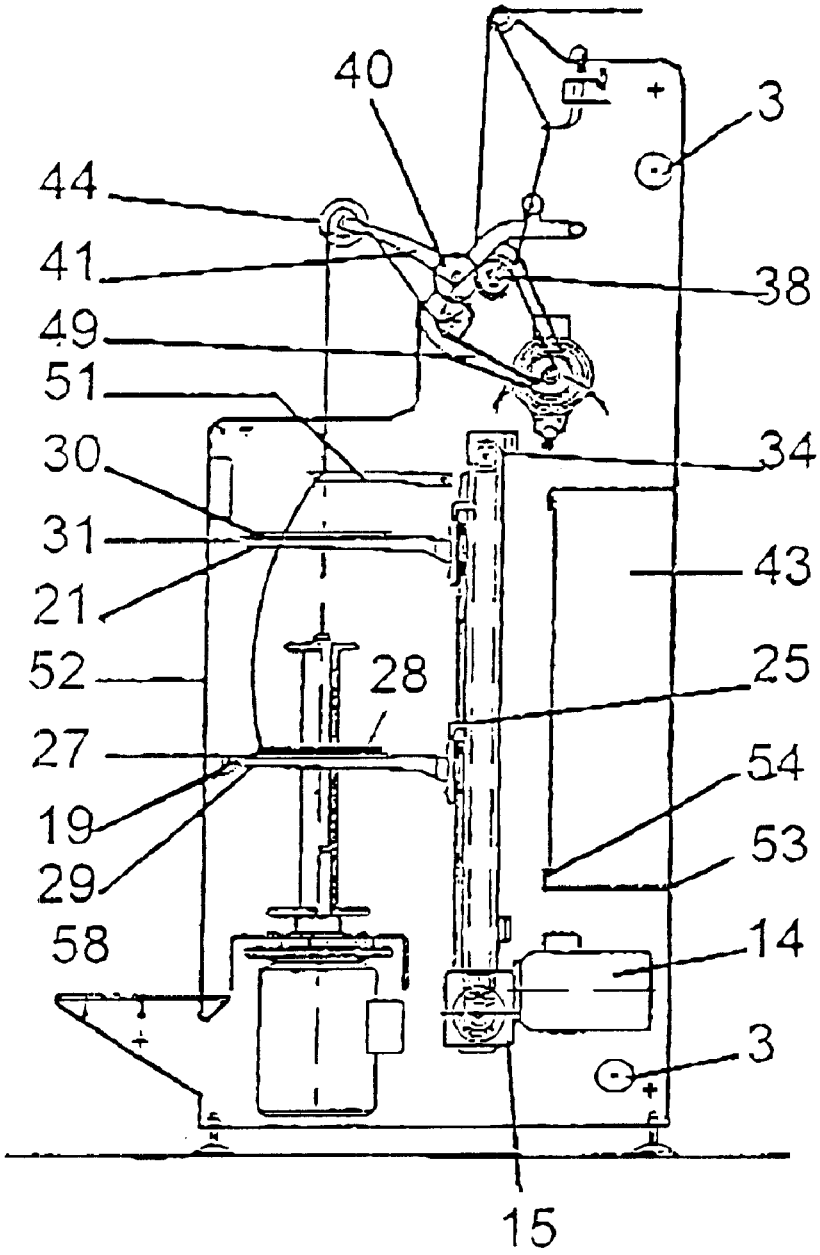
FIG. 1 VERTICAL CROSS SECTION OF THE MACHINE
Figure 2:
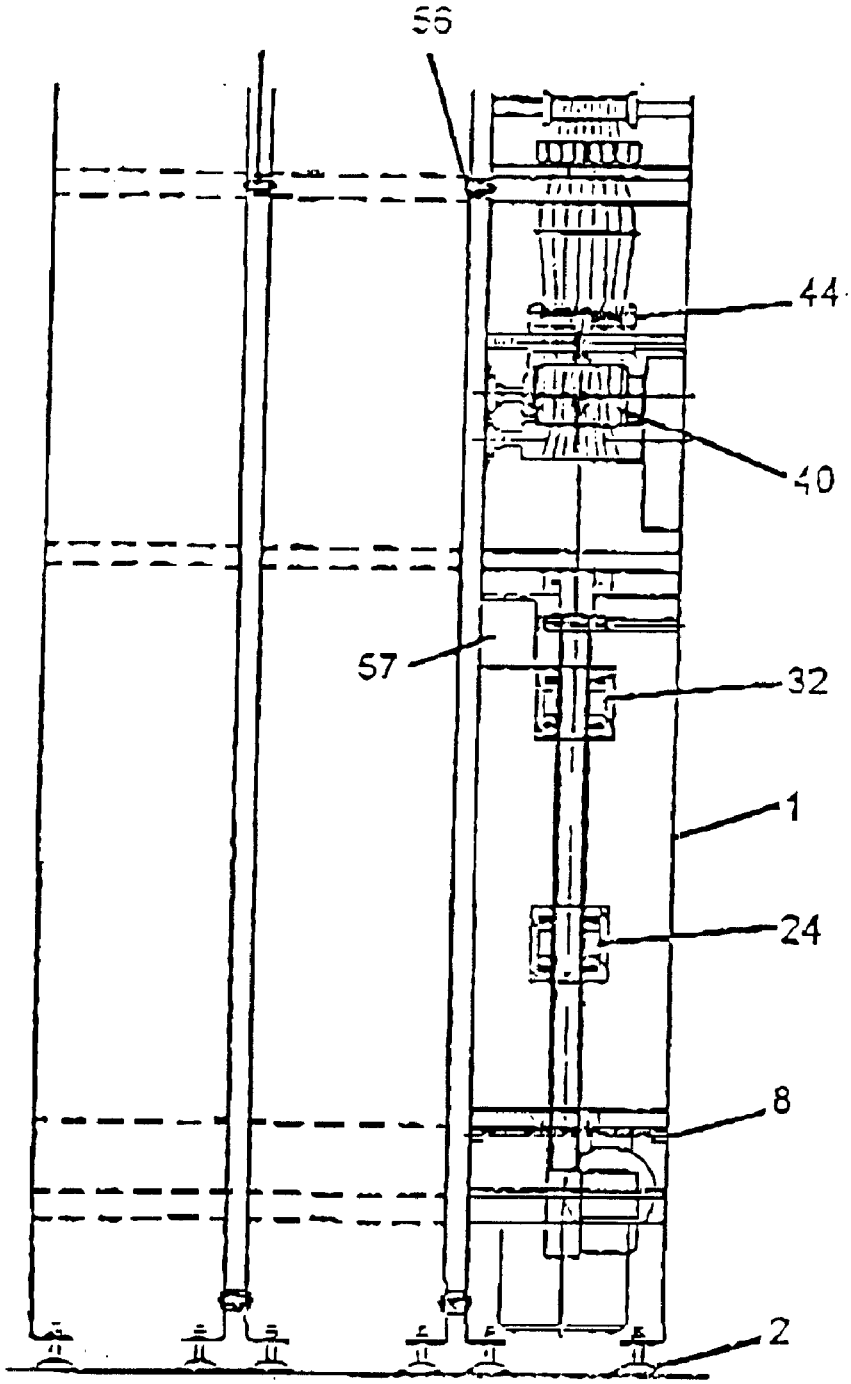
FIG. 2 ELEVATION VIEW OR FRONTAL VIEW
Figure 3:
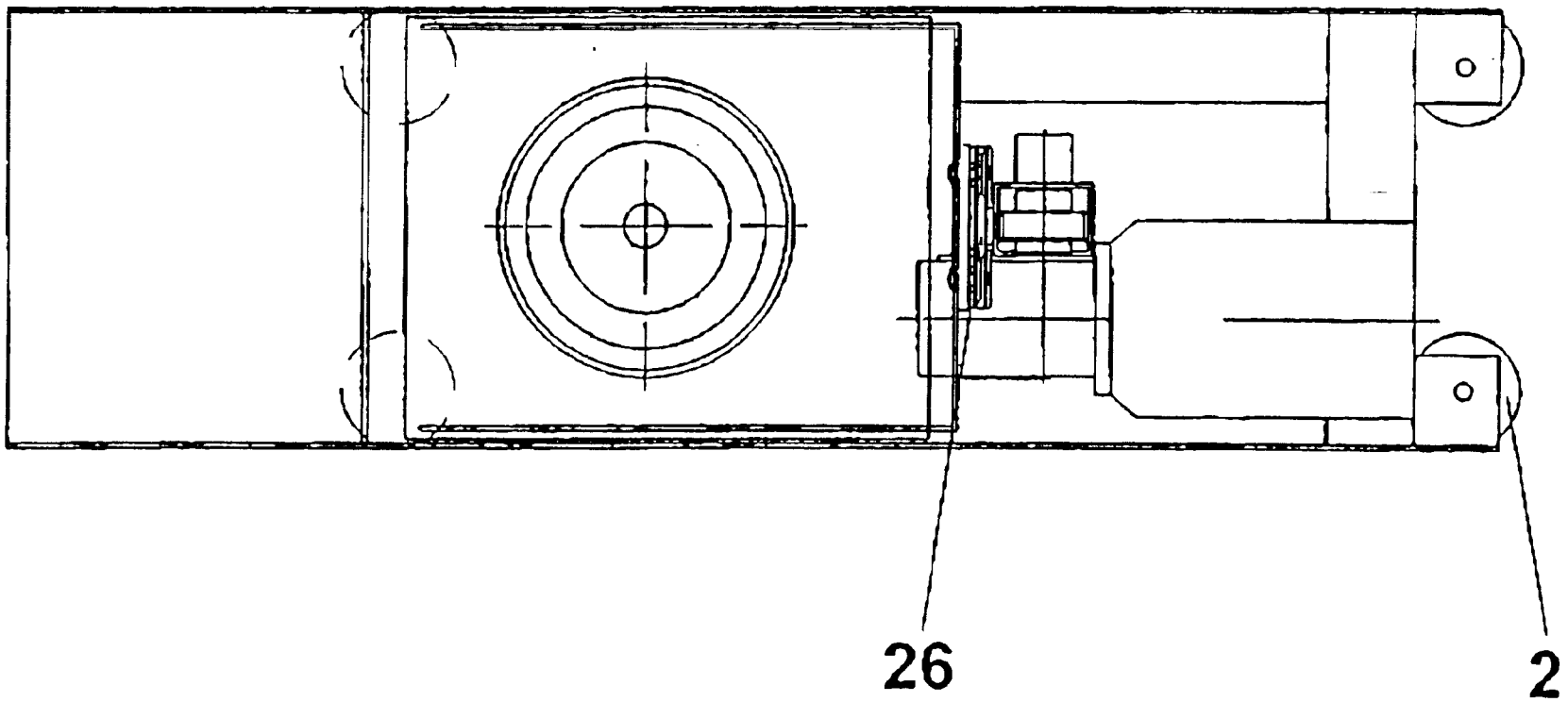
FIG. 3 PLANT VIEW
Figure 4:
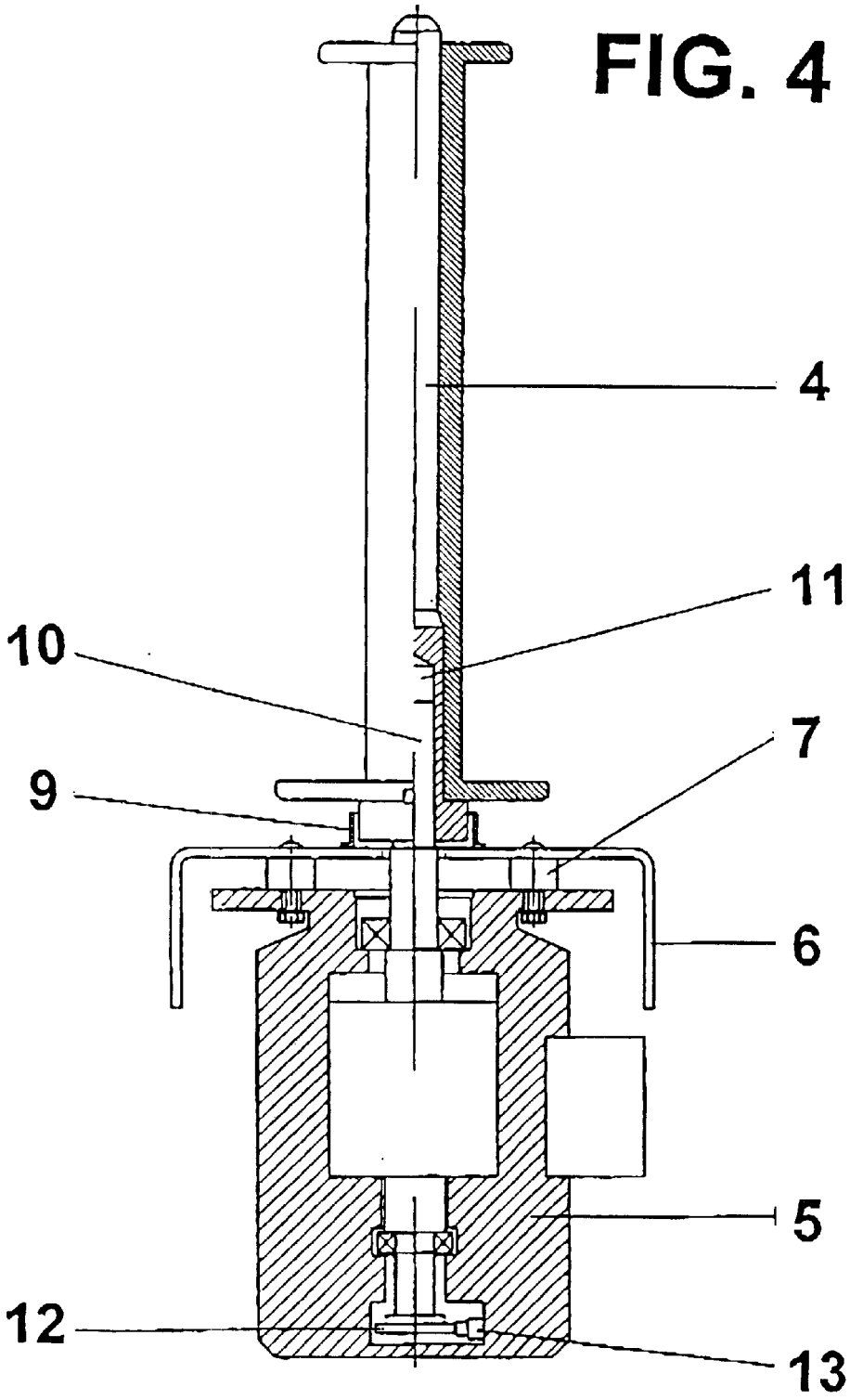
FIG. 4 DETAIL OF THE ELEVATION VIEW SHOWING THE MOTORIZED SPINDLE
Figure 5:
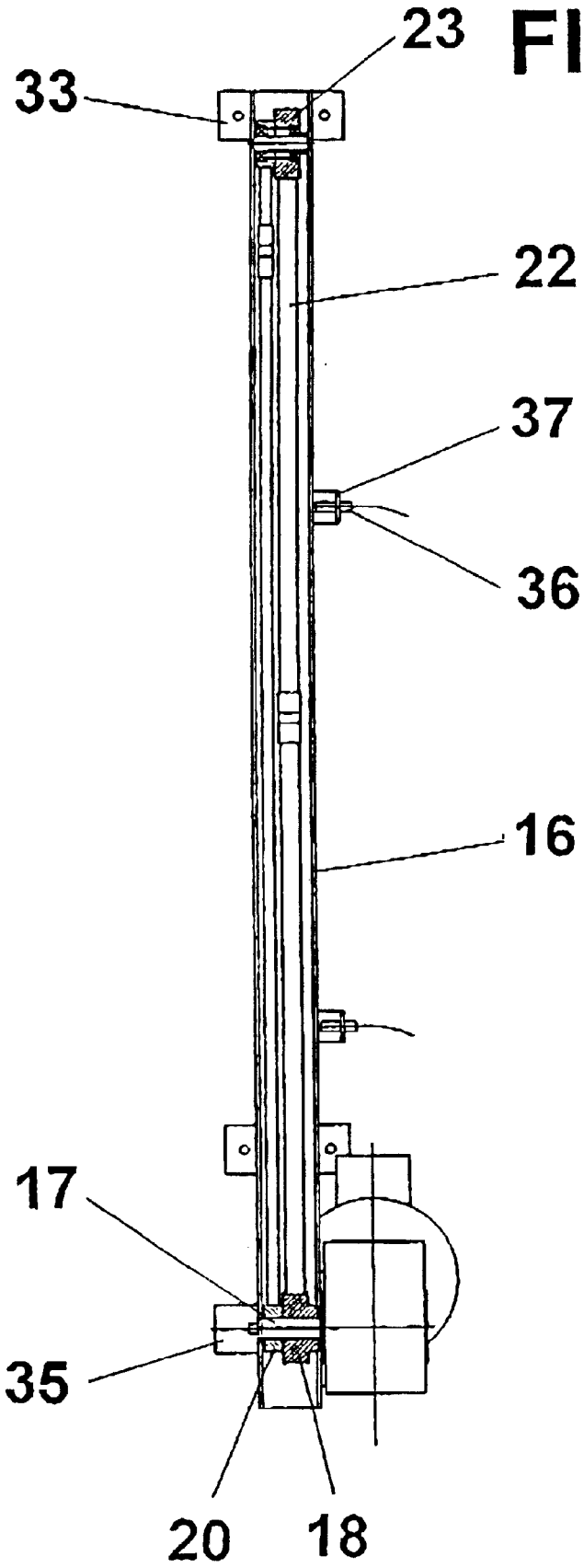
FIG. 5 DETAIL OF THE ELEVATION VIEW SHOWING THE RING RAIL
Figure 6:
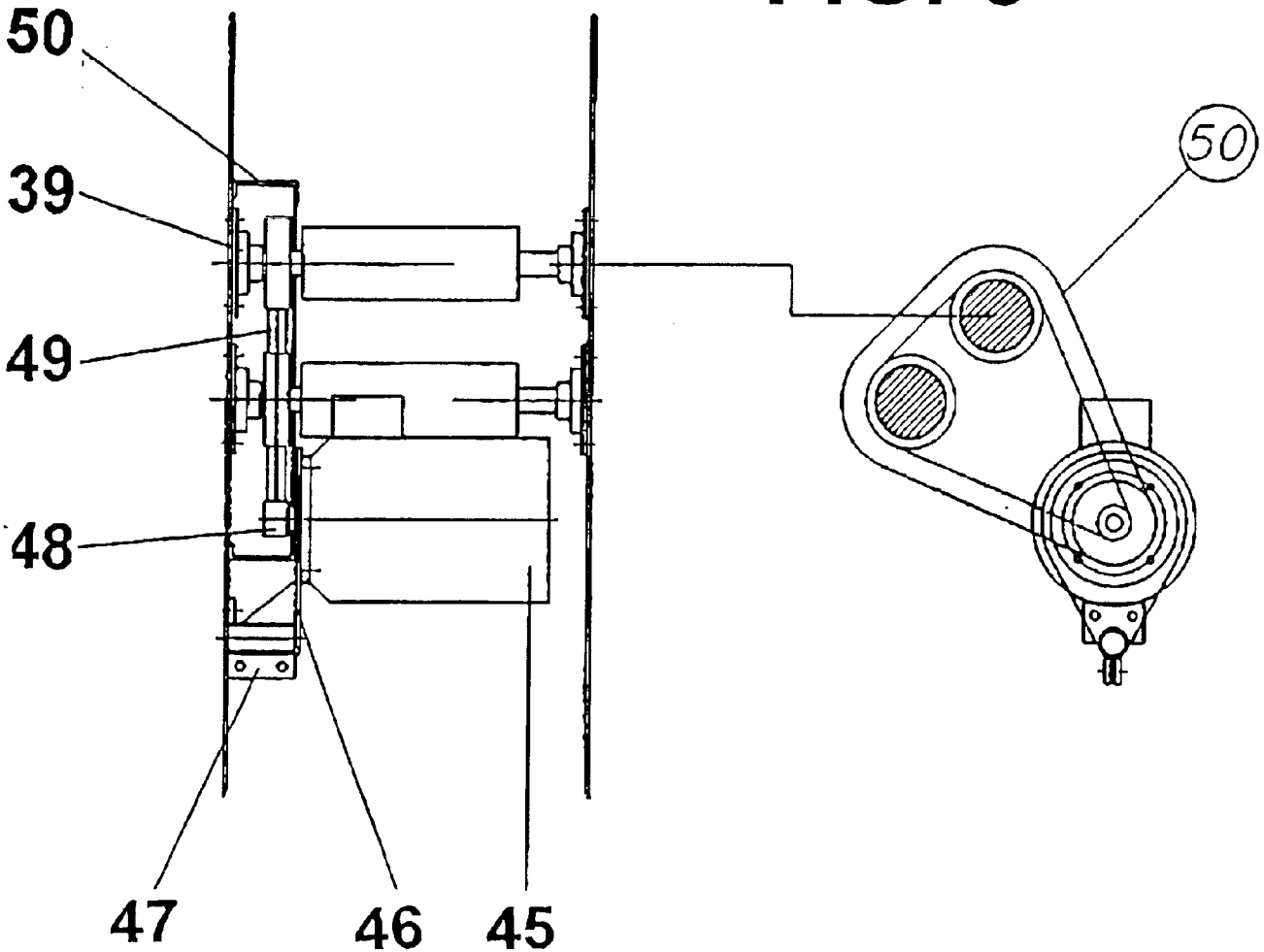
FIG. 6 DETAILS OF THE ELEVATION AND PLANT VIEWS OF THE FEEDING
Figure 7:
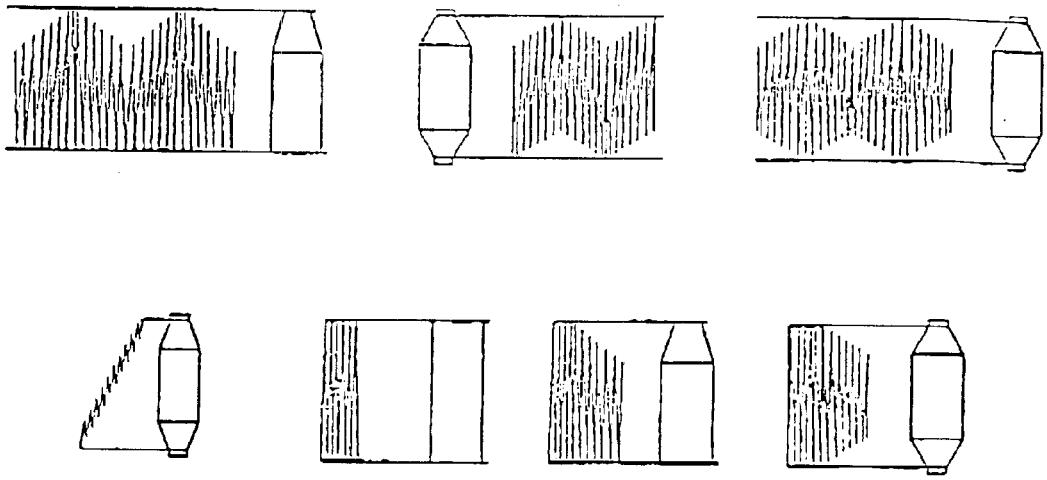
FIG. 7 BOBBIN FORMATS. These are the different formats that can be carried out simultaneously in the same machine.

The spinning doubling-joining machine with rings, of autonomous and independent unitary production modules is constituted, in each one of its modules, by the following main units:

FRAME

SPINDLE

RING RAIL

FEEDING

DESCRIPTION OF A MODULE

The module frame is constituted by two plates of steel foil (1) with a bending in its lower part to fix the supports of the machine (2), elements used for levelling the module. These two plates being united to each other by means of round bars of steel (3) screwed to the plates (1). Two billets of rectangular section (34) are fixed by their ends to the frame plates (1). These billets will be used to mount the ring rail unit.

An aluminium platform (58) is screwed by its head to the two plates with screws (56).

The spindle (4) is mounted over an asynchronous triphasic alternating current motor (5) of high performance. This motor is mounted in vertical position on a bed plate of steel foil (6) and fixed thereto with elastomer shock absorbers (7). This group is supported by the frame with billets (8) screwed to the plates (1).

A cylindrical protector (9) screwed on the bed plate (6) prevents input of threads in the motor output shaft (10). This shaft has form of Morse taper and it makes a union by conicity with the spindle (4), which has a hole (11) in form of Morse taper of the same characteristics than the shaft (10).

The motor(5) incorporates a geared wheel (12) in the lower part of the shaft (10). An inductive detector reads the number of revolutions of the motor (5).

The motor (5) is controlled by a frequency variator that is inside the electric rack (43).

An asynchronous triphasic alternating current motor (14) and a worm-gear reducer (15) drive the ring rail. These two elements are attached and they form a conventional motor reducer. This motor reducer-is screwed to a rectangular section tube (16). At the reducer output shaft (17) a geared pulley (18) is mounted, which drives the ring holder support (19). Another geared pulley (20) drives the support of the control ring (21).

A geared belt (22) is driven by the pulley (18) and another geared pulley (23) positioned in the superior part of the tube (16) makes of deflection. This is the way the linear movement of the carriage ring rail (24) is generated, said carriage ring rail is attached to the geared belt (22) by a support (25). The carriage (25) is led by means of a guide (26), which is screwed to the tube (16). A support (19) is fixed on the carriage (24) and over this support a platband of bent foil (27) is mounted. The ring (28), where the traveler (29) circulates, is housed in the platband (27).

The control ring (30) is mounted on a foil support (31) and this foil support on the support (21) previously mentioned. The complete previous set is mounted on a carriage (32).

The control ring carriage (32) is guided, fixed and driven in the same way as the ring rail carriage (24).

The tube (16), together with all the elements fixed to it, is mounted on the machine frame by a billet (33) that is welded to the tube (16) which is screwed to another billet (34).

A pulse counter (35), mounted on the reducer output shaft (17), controls the motor revolution number (14) and the ring rail position.

Two inductive detectors (36) mounted on the supports (37) mark the starting position (lower bound) and the upper bound.

The motor (14) is controlled by a frequency variator that is located inside the electric rack (43).

Feeding is carried out by two cylinders of chrome coated steel (38) in horizontal position, resting its ends on supports with oscillating ball bearing (39).

A pressure roller (40) is mounted on an arm (41), which rotates over a shaft (42) screwed to the frame plates (1) by its ends. The arm (41) allows raising the pressure roller to eliminate the pressure on the feeding cylinders (38). A grooved pulley (44) on the arm (41) drives the thread toward the spindle.

The feeding transmition is carried out by an asynchronous triphasic alternating current motor (45), provided of a pulse detector that controls the revolution number of the feeding cylinders (38), said motor (45) being controlled by a frequency variator that is located inside the electric rack (43). The motor (45) is mounted on a support (46) that oscillates over a support (47).

A geared pulley (58) is mounted in the output shaft of the motor (45). Some geared (48) pulleys are mounted on the respective feeding cylinders (38). These three pulleys are connected by a geared belt (49) forming a triangle.

A cover (50) protects the driving mechanism described previously.

Over the spindle there is a yarn guide (51) that leads and guides the thread from the feeding unit toward the traveller (29).

A polycarbonate cowling (52) in front of the spindle (4) protects the operator against an impact of a traveller (29) loosened off the ring (28).

The electric rack (43), built in steel foil, is located in the machine rear part and is mounted on profiles (53) of rectangular section. Shock absorbing pieces (54) of elastomer separate the electric rack (43) from the support bars (53).

All the electric elements of manoeuvre and control are housed inside the electric rack (43).

The modules are joint by screwing the plates (1) of the frames to each other. The screws (55) go through the two plates and between them some elastomer vibration proof pieces (56) are placed.

If the union of modules is not linear, some intermediate metallic pieces are placed in between, as necessary in order to make the layout in plant of the line that unites the different modules take an open or closed polygonal form. These intermediate pieces are manufactured from steel billets and they are joined to the plates (1) of the frame of the adjacent modules; vibration proof pieces (56) are equipped between each union piece and the plates of the frame.

The functions programmer (57) is located on the protection cowling (52). It consists of an electronic control card, a keyboard, and a display.

The control card has a number of inputs and outputs that controls the frequency variators and thus the machine operation. The card has also incorporated a communications bus.

Among other inputs it can be mentioned: speed of the spindle, speed of the feeding, speed and position of ring rail, pushbuttons, etc.

Among other outputs it can be mentioned: spindles sense of rotation, raise and descent of the ring rail in manual, etc.

The programmer of functions will also be able to control other accessories of optional character.

The machine operation parameters can be modified by the keyboard,.

The speed of the spindles, the speed of the feeding, the parameters of bobbin formation and other data and calculations can be visualised on the screen.

Optionally, it is possible to introduce the same parameters at the same time to different modules in a collective way.

By means of a "master" programmer of functions and the communication bus, the same parameters will be introduced or modified at the same time in several modules, by a programmer of functions, "slave" in this case, of each module. Nevertheless, it will be possible to modify in an independent way the parameters of any module in any moment.

What is claimed is:

1. A ring twisting and winding machine comprising:

a) a function programmer having:

(i) an electronic control card for controlling working parameters of the unitary production module;

(ii) a keyboard for introducing the working parameters; and (iii) a display for displaying the working parameters, said working parameters including feeding speed, speed and sequence of movement of the raing rail unit and the speed and turning direction of said spindle;

b) an electric rack comprising electric control elements, said electric control elements including at least one frequency variator;

c) a spindle unit for twisting and winding a thread on a bobbin, d) a first electric motor for driving said spindle unit, the first electric motor being connected to a first said frequency variator, such that a first real turning speed is controlled by said function programmer and said first frequency variator;

e) an inductive detector of said first electric motor, said inductive detector enabling the function programmer to read said first real turning speed of said first electric motor;

f) a ring rail unit for vertically reciprocating a ring holder support and a control ring support;

g) a feeding unit to supply thread to said spindle unit at a regular linear speed;

h) a module frame comprising a plurality of steel plates, with a bend in the lower parts of the steel plates, to house module supports and module leveling elements; and i) a second electric motor controlled by a second frequency variator, said second electric motor driving the ring rail unit, said second electric motor determining a linear speed and course length of the ring rail unit, said second electric motor having a pulse counter for reading a second real turning speed of the second electric motor and for transmitting the second real turning to the function programmer, the second frequency variator being controlled by the function programmer and receiving function programmer indications from a plurality of inductive detectors about vertical positions of the supports, the ring rail unit further being for guiding the thread for winding the thread onto the bobbin.

2. The machine of claim 1, wherein the linear speed of the feeding unit is controlled by a plurality of cylinders driven by a third electric motor with a third real turning speed determined by a third frequency variator, said third frequency variator being controlled by said function programmer receiving indications about said third real turning speed from a pulse detector.

3. The machine of claim 2, wherein the electric control elements control said first electric motor, said second electric motor, and said third electric motor in said machine.

4. The machine according to claim 1, wherein the steel plates are united to each other by round steel bars screwed to the steel plates, an inferior platform, and a horizontal bed plate of a steel foil bent in a u shaped form, and wherein the module frame supports and encloses the function programmer, the electric rack, the spindle unit, the ring rail unit, and the feeding unit thereby forming a unitary production module, and wherein the plates allow adjacent modules to join each other with screws and intermediate connection pieces.

5. The machine according to claim 1, wherein the machine is assembled forming diverse plant configurations by assembling together each said unitary production module to adjacent said unitary production modules, with intermediate connection pieces between said steel plates, wherein said diverse plant configuratiosn are linear, open or close polygonal.

6. The machine according to claim 5, wherein said unitary production modules are autonomous and independent from each other, said unitary production modules individually processing threads of different materials and dimensional characteristics in order to simultaneously produce bobbins of diverse diameters, heights, and folding forms, depending on thread type and the working parameters introduced int the function programmer.

7. The machine of claim 1, further comprising:

a) a function master programmer; and b) a communication bus, wherein the function master programmer and the communication bus allow a plurality of said unitary production modules to be programmed simultaneously with similar working parameters.

* * * * *